US010687614B2

(12) United States Patent
He

(10) Patent No.: US 10,687,614 B2
(45) Date of Patent: Jun. 23, 2020

(54) PORTABLE LIGHTWEIGHT CROSS-INSERT FOLDABLE DESK

(71) Applicant: Muyuan He, ShenZhen (CN)

(72) Inventor: Muyuan He, ShenZhen (CN)

( * ) Notice: Subject to any disclaimer, the term of this patent is extended or adjusted under 35 U.S.C. 154(b) by 0 days.

(21) Appl. No.: 16/257,843

(22) Filed: Jan. 25, 2019

(65) Prior Publication Data

US 2020/0093257 A1 Mar. 26, 2020

(30) Foreign Application Priority Data

Sep. 26, 2018 (CN) ..... 2018 2 1578540 U

(51) Int. Cl.

| | |
|---|---|
| ***A47B 3/06*** | (2006.01) |
| ***A47B 3/00*** | (2006.01) |
| ***A47B 13/02*** | (2006.01) |
| ***A47B 13/00*** | (2006.01) |

(52) U.S. Cl.

CPC ..... *A47B 3/06* (2013.01); *A47B 3/002* (2013.01); *A47B 13/003* (2013.01); *A47B 13/023* (2013.01); *A47B 2013/006* (2013.01)

(58) Field of Classification Search

CPC ..... A47B 3/06; A47B 3/002; A47B 13/003; A47B 47/06; A47B 55/06

See application file for complete search history.

(56) References Cited

U.S. PATENT DOCUMENTS 5,367,964 A * 11/1994 Hockensmith ..... A47B 3/14 108/180
5,669,683 A * 9/1997 Moss ..... A47B 47/06 312/259
6,267,065 B1 * 7/2001 Lin ..... A47B 13/003 108/157.14
8,079,315 B2 * 12/2011 Berent ..... A47B 3/06 108/158.12
9,949,579 B1 * 4/2018 Frost ..... A47F 5/116
10,244,860 B1 * 4/2019 Valeri ..... A47B 47/0075
2004/0055515 A1 * 3/2004 Chen ..... A47B 13/00 108/157.14
2010/0093257 A1 * 4/2010 Elliott ..... A47B 3/06 446/478
2013/0080286 A1 * 3/2013 Rotholz ..... A47C 5/005 705/26.5
2014/0230295 A1 * 8/2014 Hawkins ..... A47F 5/0025 40/606.03
2016/0076238 A1 * 3/2016 Elliott ..... A63H 33/008 52/742.13
2017/0245661 A1 * 8/2017 Heuer ..... A47B 43/00
2018/0035799 A1 * 2/2018 Leafgren ..... A47B 23/00

* cited by examiner

*Primary Examiner* — Daniel J Rohrhoff

(74) *Attorney, Agent, or Firm* — David G. Woodral; Gable Gotwals

(57) ABSTRACT

The disclosure relates to a foldable desk, comprising a first foldable panel connected to a support panel capable to be folded towards the first foldable panel, and multiple second foldable panels. If the first foldable panel and the second foldable panels are folded, the first foldable panel, the second foldable panels and the support panel can be overlapping each other. If the first foldable panel and the second foldable panels are unfolded, the second foldable panels can be inserted into the support panel so that the second foldable panels are placed perpendicular to a lower surface of the first foldable panel, and an upper surface of the first foldable panel forms a desktop.

7 Claims, 7 Drawing Sheets

PORTABLE LIGHTWEIGHT CROSS-INSERT FOLDABLE DESK

CROSS-REFERENCE TO RELATED CASES

This application claims the benefit of Chinese Patent Application No. 201821578540.8, filed on Sep. 26, 2018, and incorporates such provisional application by reference into this disclosure as if fully set out at this point.

FIELD OF THE INVENTION

The disclosure relates to the technical field of daily objects and office supplies, and particularly a foldable desk.

BACKGROUND OF THE INVENTION

When a person is seated, the blood circulation of the human body is slowed down, and the blood supply to the brain is insufficient. As a result, people tend to be tired and exhausted doing office work, causing health problems of office workers. Therefore, more and more people prefer doing work standing.

A standing desk is desired by people. However, the existing standing desks with relatively complicated structure are complicated to assemble. Such desks each occupies a large space and has a large weight, which is inconvenient for moving, carrying and using.

SUMMARY OF THE INVENTION

An objective of the disclosure is to provide a foldable desk which is simple in structure and easy to assemble and carry.

To solve the above technical problems, the disclosure employs the following technical solutions.

The foldable desk includes a first foldable panel and second foldable panels, wherein the first foldable panel is connected to a support panel which can be folded towards the first foldable panel; the second foldable panels can be folded; if the first foldable panel and the second foldable panels are folded, the first foldable panel, the second foldable panels and the support panel can be overlapping each other; if the first foldable panel and the second foldable panels are unfolded, the second foldable panels can be inserted into the support panel so that the second foldable panels are placed perpendicular to a lower surface of the first foldable panel, and an upper surface of the first foldable panel forms a desktop.

In some embodiments, first slots are formed on the support panel, a second slot is formed on each of the second foldable panels, and the first slots and the second slots can be inserted into each other so that the support panel is inserted into the second slots and the second foldable panels are inserted into the second slots.

In some embodiments, the foldable desk includes multiple support panels and second foldable panels; the support panels are arranged in parallel; the first slots formed on different support panels are parallel to each other; the number of the first slots is equal to the number of the second slots.

In some embodiments, the connecting panels are provided at ends of the first foldable panel; the connecting panels can be folded towards the first foldable panel; mounting grooves are formed on sides of the support panels; when the foldable desk is in an operating state, the ends of the connecting panels are inserted into the mounting grooves; when the foldable desk is in a folded state, the connecting panels, the first foldable panel and the support panels are overlapping each other.

In some embodiments, each of the connecting panels includes a connection section and an insertion section; the connection section is located between the insertion section and the first foldable panel; the insertion section can be folded towards the connection section and can be inserted into the mounting grooves; one side of the connection section is inserted into the openings of the mounting grooves, while the other side is perpendicular to the first foldable panel.

In some embodiments, the mounting grooves are obliquely formed on the support panels, and the opening ends of the mounting grooves are close to the first foldable panel.

In some embodiments, the foldable desk includes two foldable panels, two support panels and two connecting panels; the support panels and the connecting panels are each connected to the two ends of the first foldable panels; when the foldable desk is in an operating state, the support panels are overlapping each other, the first slots are connected to each other, and the ends of the two first foldable panels are butt-jointed and located on the same panel.

In some embodiments, the first foldable panels, the support panels and the connecting panels are all rectangular and identical in dimension; the area of the second foldable panels is two times of that of the first foldable panels; the second slots are formed in the center of the second foldable panels.

In some embodiments, all the first foldable panels, the second foldable panels, the support panels and the connecting panels are made of corrugated paper, plastics or metal.

The disclosure has the following beneficial effects. In the foldable desk of the disclosure, the assembly and disassembly of the foldable desk are achieved by folding and connecting the first foldable panel, the second foldable panels and the support panel. The foldable desk is simple in structure, quick and convenient to assemble, compact in space and easy to carry.

BRIEF DESCRIPTION OF THE DRAWINGS

The disclosure will be further described below by embodiments referring to accompanying drawings.

DETAILED DESCRIPTION OF THE PREFERRED EMBODIMENTS

The concepts, specific structures and technical effects of the disclosure will be clearly and completely described below by embodiments referring to the accompanying drawings in order to fully understand the objectives, solutions and effects of the disclosure. The embodiments in the application and the features in the embodiments can be combined if not conflicted.

Unless otherwise specified, when a certain feature is regarded as being "fixed" or "connected" to another feature, this feature may be fixed or connected to another feature either directly or indirectly. In addition, the expressions such as upper, lower, left and right used in the disclosure are merely provided with respect to the positional relationship between components in the accompanying drawings of the disclosure.

In addition, unless otherwise defined, the technical and scientific terms used herein mean the same as the common meanings interpreted by those skilled in the art. The terms used herein are merely for describing the specific embodiments, rather than limiting the disclosure. The term "and/or" used herein includes any combination of one or more of related listed items.

Embodiment 1

Figure 1:
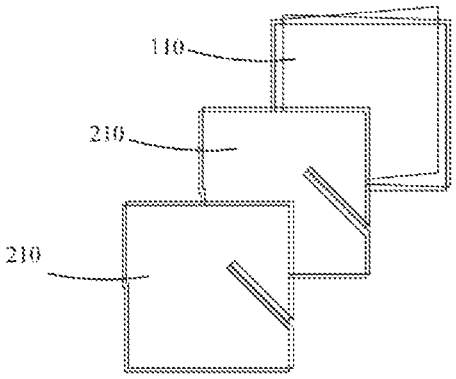
FIG. 1 is a schematic structural diagram of a first state of a first embodiment of the foldable desk according to the disclosure.
Figure 2:
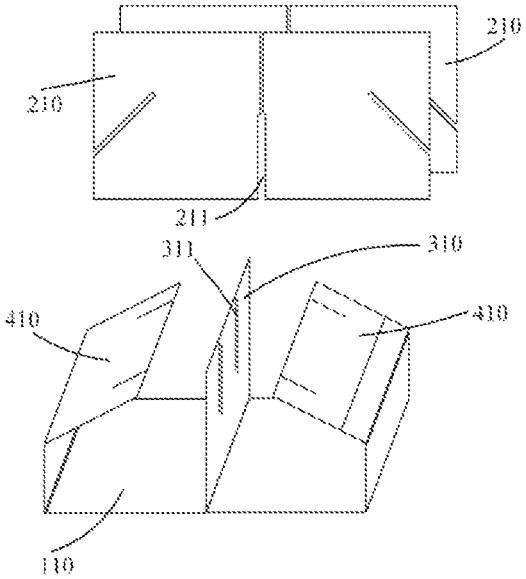
FIG. 2 is a schematic structural diagram of a second state of the first embodiment of the foldable desk according to the disclosure.
Figure 3:
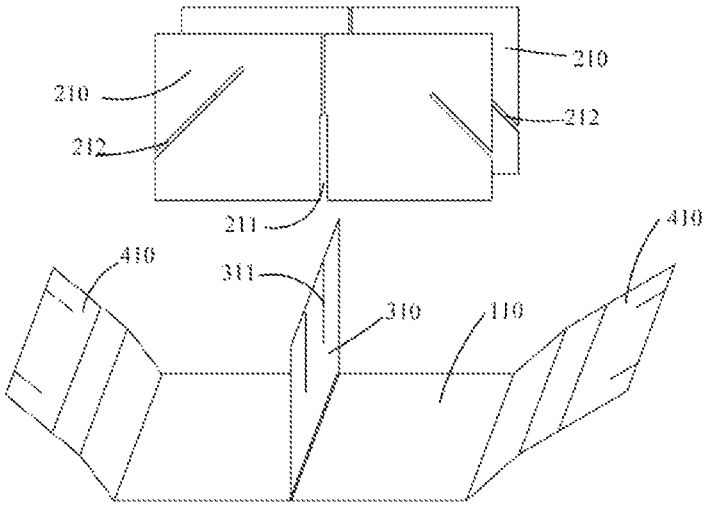
FIG. 3 is a schematic structural diagram of a third state of the first embodiment of the foldable desk according to the disclosure.
Figure 4:
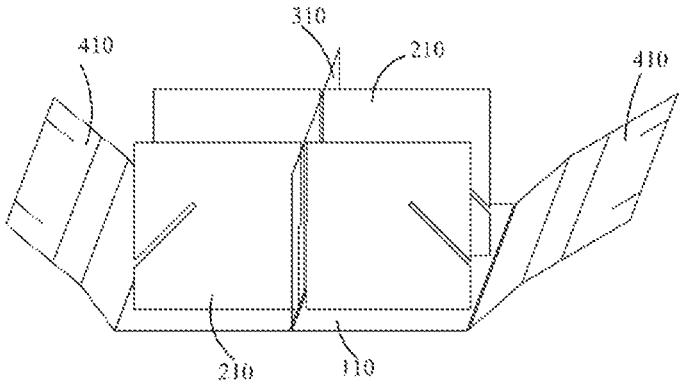
FIG. 4 is a schematic structural diagram of a fourth state of the first embodiment of the foldable desk according to the disclosure.
Figure 5:
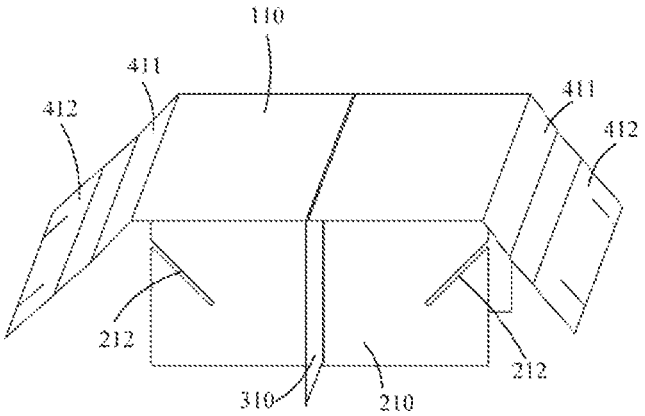
FIG. 5 is a schematic structural diagram of a fifth state of the first embodiment of the foldable desk according to the disclosure.
Figure 6:
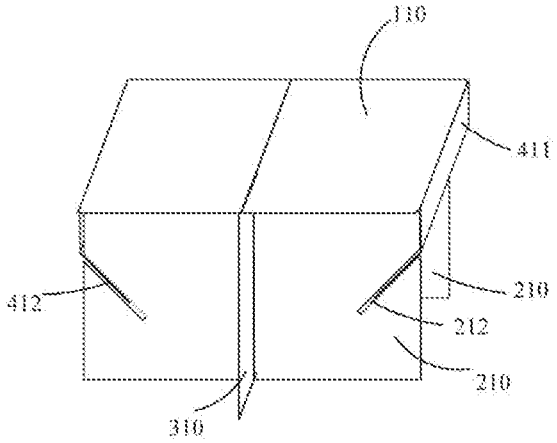
FIG. 6 is a schematic structural diagram of a sixth state of the first embodiment of the foldable desk according to the disclosure.
Figure 7:
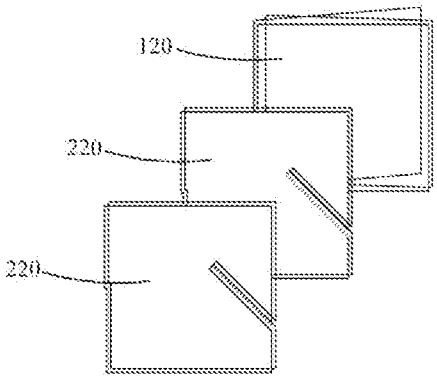
FIG. 7 is a schematic structural diagram of a first state of a second embodiment of the foldable desk according to the disclosure.
Figure 8:
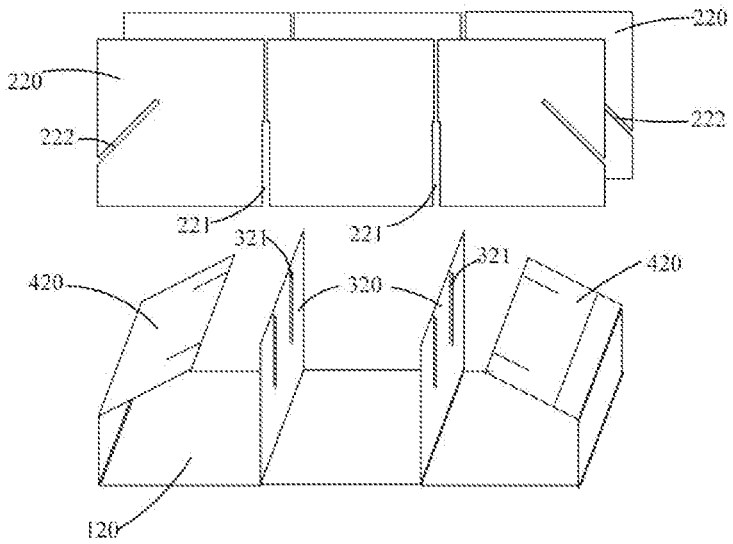
FIG. 8 is a schematic structural diagram of a second state of the second embodiment of the foldable desk according to the disclosure.
Figure 9:
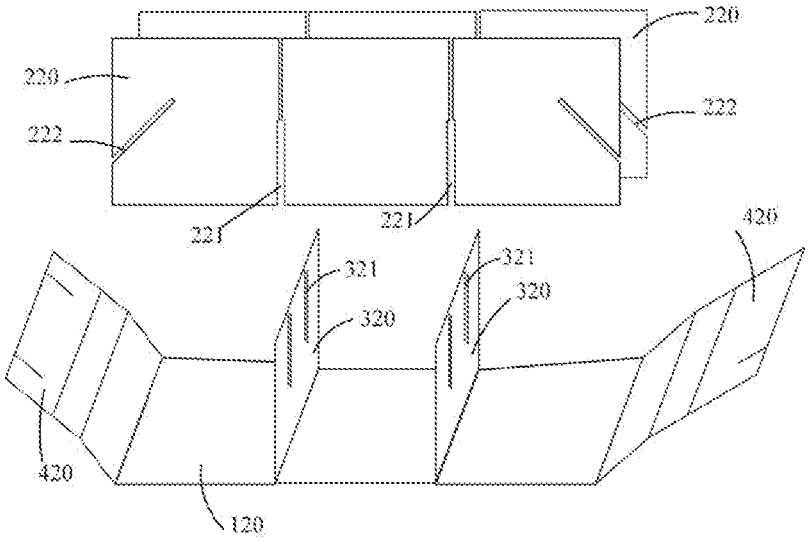
FIG. 9 is a schematic structural diagram of a third state of the second embodiment of the foldable desk according to the disclosure.
Figure 10:
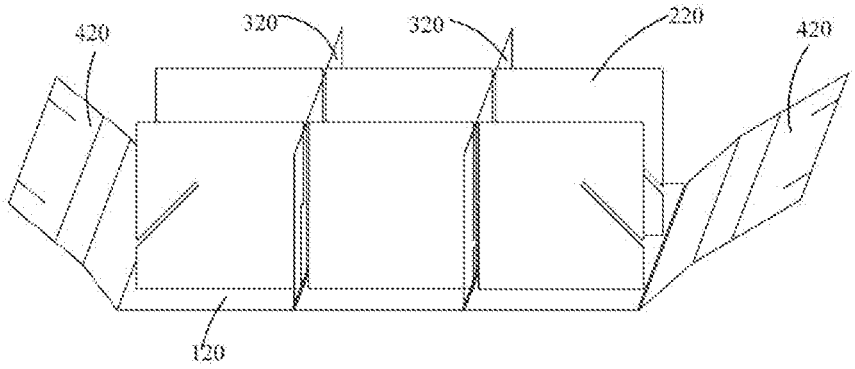
FIG. 10 is a schematic structural diagram of a fourth state of the second embodiment of the foldable desk according to the disclosure.
Figure 11:
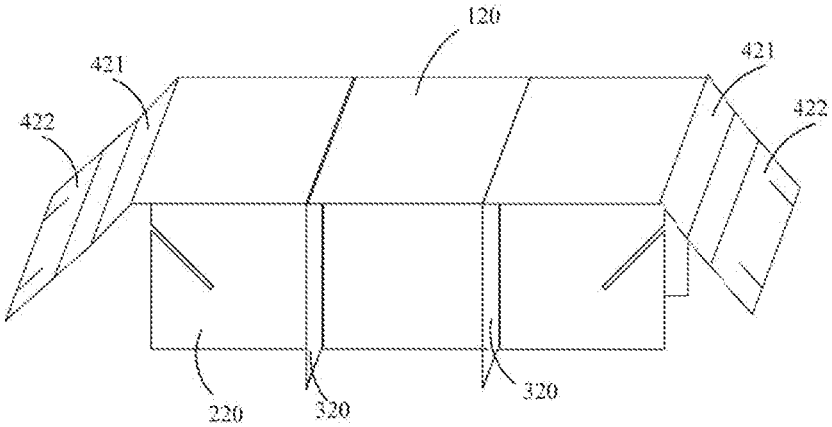
FIG. 11 is a schematic structural diagram of a fifth state of the second embodiment of the foldable desk according to the disclosure.
Figure 12:
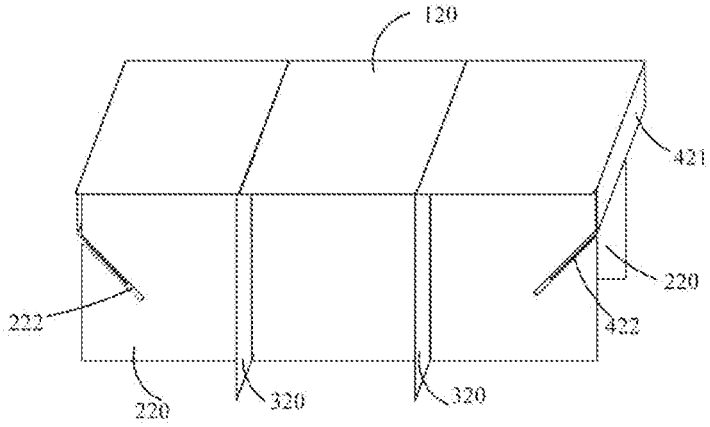
FIG. 12 is a schematic structural diagram of a sixth state of the second embodiment of the foldable desk according to the disclosure.
Figure 13:
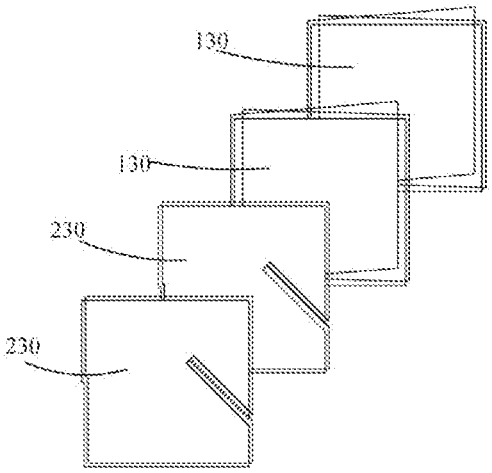
FIG. 13 is a schematic structural diagram of a first state of a third embodiment of the foldable desk according to the disclosure.
Figure 14:
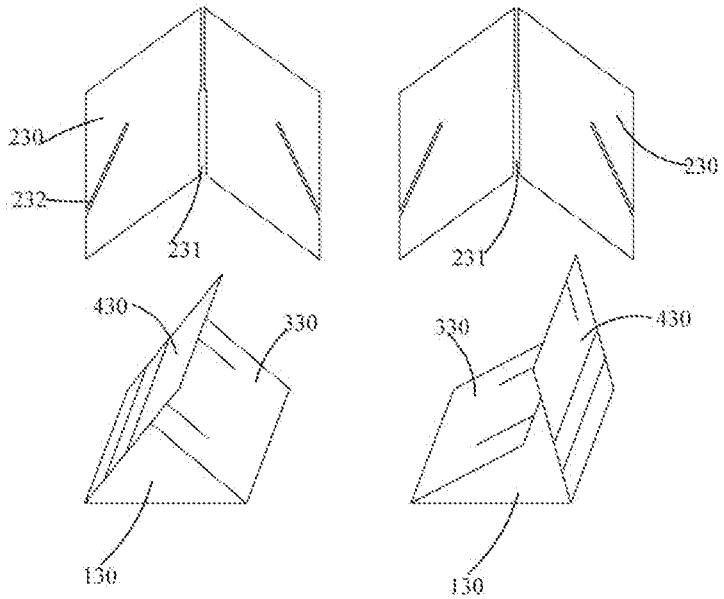
FIG. 14 is a schematic structural diagram of a second state of the third embodiment of the foldable desk according to the disclosure.
Figure 15:
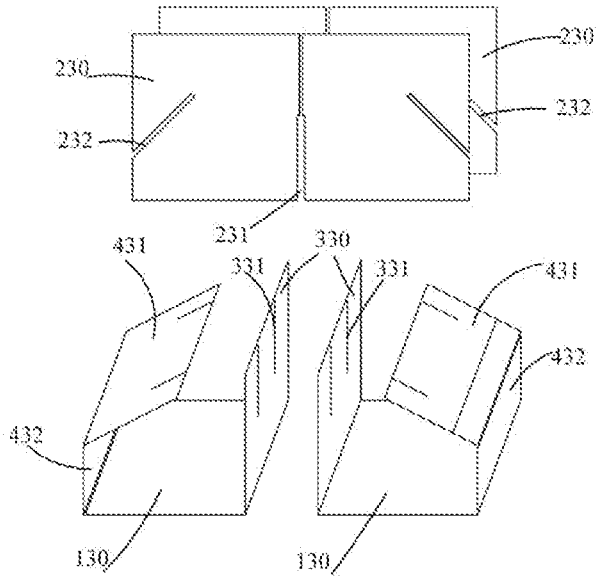
FIG. 15 is a schematic structural diagram of a third state of the third embodiment of the foldable desk according to the disclosure.
Figure 16:
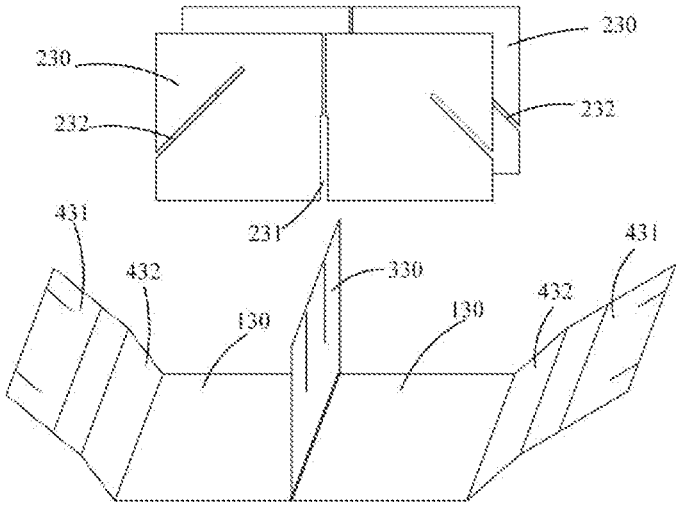
FIG. 16 is a schematic structural diagram of a fourth state of the third embodiment of the foldable desk according to the disclosure.

Referring to FIGS. 1-6, the foldable desk in the embodiment includes a first foldable panel 110 and second foldable panels 210. A support panel 310 is provided on the first panel 110. The support panel 310 and the first foldable panel 110 can be folded towards each other, so that the first foldable panel 110 and the support panel 310 are overlapping each other, after the first foldable panel 110 and the support panel 310 are folded. The second foldable panels 210 can be folded in the middle. The shape of the second foldable panels 210 after folded is the same as that of the first foldable panel 110 after folded, so that the second foldable panels 210 can overlap the first foldable panel 110 in a state where the foldable desk is folded but not used, as shown in FIG. 1. This makes it convenient to carry.

When the first foldable panel 110 and the second foldable panels 210 are unfolded, the support panel 310 is vertically connected to the first foldable panel 110. Preferably, the support panel 310 is located in the center of the first foldable panel 110, and the second foldable panels 210 can be inserted into the support panel 310, so that one side of each of the second foldable panels 210 is placed perpendicular to the surface of the first foldable panel 110. As a result, the first foldable panel 110, the second foldable panels 210 and the support panel 310 are perpendicular to each other. The second foldable panels 210 locate in the same panel as one side of the support panel 310, on the opposite side of the first foldable panel 110. The surface of the first foldable panel 110 can be used as a desktop, and the support panel 310 and the second foldable panels 210 can be used as legs. The second foldable panels 210 and the support panel 310 touches the ground, to ensure the stability of the whole foldable desk.

Preferably, first slots 311 are formed on the support panel 310, and a second slot 211 is formed on each of the second foldable panels 210. The second slot 211 is formed in the center of each of the second foldable panels 210. The second foldable panels 210 can go through the first slots 311, so that the support panel 310 is inserted into the second slots 211. Similarly, the support panel 310 can go through the second slots 211, so that the second foldable panels 210 are inserted into the first slots. Accordingly, the connection of the second foldable panels 210 and the support panel 310 is achieved. In the embodiment, there are two second foldable panels 210, and a second slot 211 is formed on each of the second foldable panels 210. Correspondingly, two slots 311 are formed on the support panel 310. The distance between the first slots 311 can be adjusted. Therefore, as long as the number of the first slots 311 is equal to the number of the second slots 211, the number of the second foldable panels 210 can be calculated. The second foldable panels 210 are arranged in parallel and connected to the support panel 310. By providing multiple second foldable panels 210, the stability of the foldable desk can be improved.

Connecting panels 410 are further provided on two sides of the first foldable panel 110. The connecting panels 410 can be folded towards the first foldable panel 110. Mounting grooves 212 are formed on the second foldable panels 210, and the ends of the connecting panels 410 can be inserted into the mounting grooves 212 to further improve the stability of the structural connection.

Preferably, each of the connecting panels 410 includes a connection section 411 and an insertion section 412. The connection section 411 is located between the first foldable panel 110 and the insertion section 412, and the insertion section 412 is located at the end of the connecting panel 410. The mounting grooves 212 are formed on two sides of the second foldable panels 210. The mounting grooves 212 are obliquely formed on the second foldable panels 210. Opening ends of the mounting grooves 212 are close to the first foldable panel 210, so that the insertion sections 412 are conveniently inserted into the mounting grooves 212. The connection sections 411 are perpendicular to the first foldable panel 110. After the whole foldable desk is assembled, the connection relation between the first foldable panel 110 and the second foldable panels 210 is optimized by the support effect of the connecting panels 410, so that the connection strength of the whole structure is improved.

In the embodiment, all the first foldable panel 110, the second foldable panels 210, the support panel 310 and the connecting panels 410 can be made of corrugated paper, plastics or metal.

The foldable desk in the embodiment can be used by people who prefer standing while working. The length and shape of the first foldable panel 110, the second foldable panels 210, the support panel 310 and the connecting panels 410 can be configured according to the specific conditions of a user. Preferably, the shape is a square size of 31 cm×31 cm.

Embodiment 2

Referring to FIGS. 7-12, the diffidence between this embodiment and Embodiment 1 is that two second slots 221 are formed on each of the second foldable panels 220 in the embodiment. The second slots 221 are formed on three trisection lines of the second foldable panels. Therefore, the shape of the second foldable panels 220 after folded in the embodiment is the same with the second foldable panels 220 in Embodiment 1. Correspondingly, two support panels 320 are connected to the first foldable panel 120. The support panels 320 are connected to the second foldable panel 120, and perpendicular to the first foldable panel 120. The support panels 320 are located on trisection lines of the first foldable panel 120, respectively. Accordingly, after the foldable panel 120 and the support panels 320 are folded, the shape is the same as that of the first foldable panel 120 in Embodiment 1, so that it is convenient to carry and manage the foldable desk. In the embodiment, the number of the second slots 221 and the number of the support panels 320 can be increased or decreased according to actual needs in order to satisfy different usages.

In the embodiment, there are two second foldable panels 220, two first slots 321 are formed on each of the support panels 320, and the first slots 321 formed on different support panels 320 are parallel to each other. Therefore, the second slots 221 on the second foldable panels 220 are inserted the first slots 321 in one row. Mounting grooves 222 are formed on the two sides of the second foldable panels 220, and connecting panels 420 are provided on two sides of the first foldable panel 120. Similarly, each of the connecting panels 420 includes a connection section 421 and an insertion section 422; the connection section 421 is located between the first foldable panel 120 and the insertion section 422; the insertion section 422 is located at an end of the connecting panel 420. Mounting grooves 222 are formed on the two sides of the second foldable panels 220, and the insertion section 422 can be inserted into the mounting grooves 222 to further improve the stability of the foldable desk.

The embodiment is applicable to persons using a large office area, and applicable to different scenarios, keeping the portability and stability.

Embodiment 3

Referring to FIGS. 13-16, the difference between this embodiment and Embodiment 1 is that the foldable desk in the embodiment includes two first foldable panels 130, two connecting panels 430 and two support panels 330. The connecting panels 430 and the support panels 330 are located on two sides of the first foldable panels 130. The connecting panels 430, the first foldable panels 130 and the support panels 330 are identical in shape, so the three are overlapping each other when folded. The second foldable panels 230 are the same as that in Embodiment 1. The foldable panels 230 can also overlap the first foldable panels 130 after folded. The foldable desk is small and easy to carry and transport.

After the first foldable panels 130, the connecting panels 430 and the support panels 330 are unfolded, the support panels 330 are perpendicular to the first foldable panels, and the two support panels 330 are close to and overlapping each other, so that the first foldable panels 130 are butt-jointed at the support panels 330. First slots 331 and slots 231 are inserting to each other, so that second slots 231 on the second foldable panels 230 can stably connected to the first slots 331. The second foldable panels 230 support the first foldable panels 130 to prevent the first foldable panels 130 from collapsing. Moreover, the two support panels 330 are tightly overlapping each other, to avoid the separation of the support panels 330 is avoided, and to stabilize the foldable desk.

By connecting two sides of the first foldable panels 130 to the support panels 330 and the connecting panels 430, it is convenient to fold the first foldable panels, the support panels and the connecting panels, the structure is simpler, and it is easy to assemble and disassemble. The arrangement of the connecting panels 430, the connection sections 431, the insertion sections 432 and the mounting grooves 232 is the same as that in Embodiment 1, so that the stability of the whole structure is further enhanced.

Although the preferred embodiments of the disclosure have been specifically described above, the disclosure is not limited thereto. Those skilled in the art can make various equivalent transformations or replacements without departing from the spirit of the disclosure, and these equivalent transformations or replacements shall fall into the scope defined by the appended claims of the disclosure.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A foldable desk comprising:

a first foldable panel connected to a support panel capable to be folded towards the first foldable panel; and multiple second foldable panels;

wherein:

if the first foldable panel and the second foldable panels are folded, the first foldable panel, the second foldable panels and the support panel can be overlapping each other; and if the first foldable panel and the second foldable panels are unfolded, the second foldable panels can be inserted into the support panel so that the second foldable panels are placed perpendicular to a lower surface of the first foldable panel, and an upper surface of the first foldable panel forms a desktop;

wherein, a plurality of first slots are formed on the support panel, a second slot is formed on each of the second foldable panels, and the first slots and the second slots can be inserted into each other so that the support panel is inserted into the second slots and the second foldable panels are inserted into the second slots; and wherein, connecting panels are provided at ends of the first foldable panel; the connecting panels can be folded relative to the first foldable panel; mounting grooves are formed on sides of the support panels; when the foldable desk is in an operating state, the ends of the connecting panels are inserted into the mounting grooves; and, when the foldable desk is in a folded state, the connecting panels, the first foldable panel and the support panels are overlapped.

2. The foldable desk according to claim 1, further comprising:

multiple support panels;

wherein the support panels are arranged in parallel on the first foldable panel;

wherein the first slots formed on different support panels are parallel to each other; and wherein the number of the first slots is equal to the number of the second slots.

3. The foldable desk according to claim 1, wherein:

each of the connecting panels comprises a connection section and an insertion section;

the connection section is located between the insertion section and the first foldable panel;

the insertion section can be folded towards the connection section and can be inserted into the mounting grooves; and one side of the connection section is placed perpendicular to the openings of the mounting grooves, while the other side thereof is perpendicular to the first foldable panel.

4. The foldable desk according to claim 3, wherein the mounting grooves are obliquely formed on the support panels, and opening ends of the mounting grooves are close to the first foldable panel.

5. The foldable desk according to claim 3, further comprising:

two foldable panels, two support panels and two connecting panels;

wherein the support panels and the connecting panels are connected to the two ends of the first foldable panels; and wherein when the foldable desk is in an operating state, the support panels are overlapping each other, the first slots are connected to each other, and the ends of the two first foldable panels are butt-jointed and located on a same panel.

6. The foldable desk according to claim 5, wherein:

the first foldable panels, the support panels and the connecting panels are all rectangular and identical in dimension;

the area of the second foldable panels is two times of that of the first foldable panels; and the second slots are formed in the center of the second foldable panels.

7. The foldable table according to claim 1, wherein all the first foldable panels, the second foldable panels, the support panels and the connecting panels are made of corrugated paper, plastics or metal.

* * * * *